US009340321B2

(12) United States Patent
Ness

(10) Patent No.: US 9,340,321 B2
(45) Date of Patent: May 17, 2016

(54) PUMP ASSEMBLY STORAGE BOX AND WORK PLATFORM METHOD AND APPARATUS

(71) Applicant: Tom Gurtner, New Orleans, LA (US)

(72) Inventor: Daniel Ness, Metairie, LA (US)

( * ) Notice: Subject to any disclaimer, the term of this patent is extended or adjusted under 35 U.S.C. 154(b) by 0 days.

(21) Appl. No.: 14/538,250

(22) Filed: Nov. 11, 2014

(65) Prior Publication Data

US 2015/0166220 A1 Jun. 18, 2015

Related U.S. Application Data

(60) Provisional application No. 61/902,508, filed on Nov. 11, 2013.

(51) Int. Cl.
*B60P 7/00* (2006.01)
*B65D 19/02* (2006.01)
(Continued)

(52) U.S. Cl.
CPC ..... *B65D 19/02* (2013.01); *B65D 19/06* (2013.01); *B65D 88/129* (2013.01); *B65D 2590/0066* (2013.01); *B65D 2590/0091* (2013.01)

(58) Field of Classification Search
CPC ..... B65D 19/02; B65D 19/06; B65D 88/129; B65D 2590/006; B65D 2590/009
USPC ..... 410/32, 35, 46; 206/386, 596, 600; 108/55.1, 56.1, 56.3; 211/195
See application file for complete search history.

(56) References Cited

U.S. PATENT DOCUMENTS 6,357,365 B1 3/2002 Higgins et al.
6,915,815 B1 7/2005 Ness
(Continued)

FOREIGN PATENT DOCUMENTS

GB 2004525 A 4/1979

OTHER PUBLICATIONS

PCT International Search Report and Written Opinion, PCT/US2014/064971, dated Jun. 10, 2015.

*Primary Examiner* — Stephen Gordon
(74) *Attorney, Agent, or Firm* — Garvey, Smith, Nehrbass & North, L.L.C.; Charles C. Garvey, Jr.; Vanessa M. D'Souza

(57) ABSTRACT

A method of transporting fluid containing tanks and of off loading the fluid contents of the tanks. Providing a frame having a base with a floor, a front, a rear, and upper and lower end portions, the frame including a plurality of side walls extending upwardly from the base and including at least left and right side walls. Mounting a plurality of gates to the frame, each spanning between two corner columns, each gate being movable between open and closed positions, the open position of each gate providing an open doorway, the gates enabling a fork lift to place a selected one of the tanks on the floor by moving the selected load module laterally through a the open doorway. The floor having a plurality of load holding positions. Placing one or more tanks and a work platform on the floor, wherein the work platform has a work surface and a storage area, and a folding staircase that is movable between upper and lower positions, wherein in the lower position stairs are provided that enable a user to climb the stairs and occupy the platform work surface and wherein in the upper position the stairs are positioned above the work surface. The gates enabling removal of any one of the tanks or the work platform laterally when a gate is opened and without removing any other tank. Transporting the frame from a beginning location to an ending location, and wherein the work platform remains on the frame.

16 Claims, 8 Drawing Sheets

(51) Int. Cl.
*B65D 19/06* (2006.01)
*B65D 88/12* (2006.01)

(56) References Cited

U.S. PATENT DOCUMENTS

| | | | | |
|---|---|---|---|---|
| 6,983,704 | B1 | 1/2006 | Ness | |
| 7,520,707 | B1 | 4/2009 | Ness | |
| 7,552,687 | B1 | 6/2009 | Ness | |
| 7,997,214 | B1 | 8/2011 | Ness | |
| 8,079,791 | B2 | 12/2011 | Ness | |
| 8,104,501 | B1 | 1/2012 | Ness | |
| 8,231,316 | B2 | 7/2012 | Ness | |
| 8,336,450 | B1 | 12/2012 | Ness | |
| 8,490,552 | B2 | 7/2013 | Ness | |
| 8,506,219 | B2 | 8/2013 | Ness | |
| 9,061,822 | B2 * | 6/2015 | Ness | B65D 19/00 410/46 |
| 2010/0178126 | A1 | 7/2010 | Ness | |

* cited by examiner

PUMP ASSEMBLY STORAGE BOX AND WORK PLATFORM METHOD AND APPARATUS

CROSS-REFERENCE TO RELATED APPLICATIONS

Priority of U.S. Patent Application Ser. No. 61/902,508, filed 11 Nov. 2013, hereby incorporated herein by reference, is hereby claimed.

STATEMENT REGARDING FEDERALLY SPONSORED RESEARCH OR DEVELOPMENT

Not applicable

REFERENCE TO A "MICROFICHE APPENDIX"

Not applicable

BACKGROUND OF THE INVENTION

1. Field of the Invention

The present invention relates to a rack and work platform apparatus for transporting fluid tanks to a selected location such as an offshore marine location. More particularly, the present invention relates to an improved combination rack and work platform apparatus wherein the rack apparatus supports one or more fluid holding tanks and a specially configured work platform, the work platform including a tool box portion that houses equipment such as pumps and/or hoses, the platform having a folding staircase arrangement that comprises part of the tool box and converts to a staircase that enables workers to use the work platform to access the upper end portions of the fluid holding tank or tanks upon arrival to a selected destination.

2. General Background of the Invention

The offshore oil and gas industry has come into using various specialized fluids as part of the oil and gas exploration and drilling process. Specially configured racks have been used to transport fluid holding tanks from a land-based location to offshore marine platforms. For example, U.S. Pat. Nos. 6,915,815; 6,983,704; 7,520,707; 7,552,687; 7,997,214; 8,079,791; 8,104,501; 8,231,316; 8,336,450; 8,490,552, 8,506,219; disclose rack arrangements, each hereby incorporated herein by reference.

Many transportable fluid holding tanks have upper end portions with fittings, manways, covers and the like. Safety considerations and regulations forbid workers from climbing on tanks in order to access these covers and fittings. A safe work platform would be desired in order to enable users or workers to access the upper end portions of the tanks.

BRIEF SUMMARY OF THE INVENTION

Embodiments of the present invention provide a method of transporting fluid containing tanks and a specially configured work platform as well as offloading the fluid contents of the tanks. As part of the method, there is provided a frame having abase with a floor, a front, a rear, and upper and lower end portions, the frame including a plurality of side walls extending upwardly from the base and including at least left and right side walls.

One or more gates are mounted to the frame. Each gate can span between two corner columns. Each gate is movable between open and closed positions. The open position of each gate provides an open doorway for enabling a fork lift to place a selected one of the tanks or modules on the floor by moving the selected tank or module laterally through an open doorway. The floor has a plurality of load holding positions that are occupied by a fluid holding tank or tanks and the specially configured work platform.

During transport, one or more tanks and the work platform are placed on the floor. The work platform has a work surface, a storage area, and a folding staircase that is movable between upper and lower positions. In the lower position, stairs are provided that enable a user to climb the stairs and occupy the platform work surface. In the upper position the stairs are positioned above the work surface.

The gates enable removal of any one of the tanks or the work platform laterally when a gate is opened and without removing any other tank. The tanks and work platform can remain on the frame wherein the work platform enables access to the upper surface of the tanks and their inlet openings, manway(s) and fittings.

As part of the method, the frame is transported from a beginning location (e.g. on shore or on land) to an ending location (e.g. offshore marine platform such as an oil well drilling or production platform). The work platform typically remains on the frame wherein the folding staircase section can be rotated to a lower position which exposes the steps or stairs to a user.

Various embodiments of the present invention include between two and four load holding positions.

Various embodiments of the present invention include at least a pair of gates.

In various embodiments of the present invention, the staircase pivots about hinges when moving from the upper and lower position.

In various embodiments of the present invention, the floor is at least partially inclined.

In various embodiments of the present invention, one or more pumps are contained in the storage area of the work platform.

In various embodiments of the present invention, in the upper position the staircase and work surface form a support surface for holding a pallet.

In various embodiments of the present invention, lift eyes are provided on columns of the frame.

Various embodiments of the apparatus of the present invention provide a cargo rack having a frame having a base with a floor, a front, a rear, upper and lower end portions.

A plurality of load modules are supported within the frame and upon the floor during use. These modules can include one or more fluid holding tanks and a specially configured combination work platform/tool box.

The frame includes a plurality of side walls that extend upwardly from the base including at least left and right side walls.

A plurality of gates are movably mounted on the frame, each gate placed at a frame end. Each gate is movable between open and closed positions, the gates enabling the load modules to be loaded laterally to the floor when a said gate is opened.

The floor has a plurality of load holding positions, at least one load holding position having a fluid holding tank and at least one holding position having a load module that is a work platform.

The gates enable any one of the modules to be removed laterally with a fork lift when a said gate is opened.

In various embodiments of the present invention, the frame includes multiple corner columns.

In various embodiments of the present invention, the frame includes multiple intermediate columns.

In various embodiments of the present invention, each intermediate column is connected to a corner column.

In various embodiments of the present invention, there are multiple horizontal members that span between each corner column and an intermediate column.

In various embodiments of the present invention, the frame has lifting eyes.

In various embodiments of the present invention, there are one or more transverse beams that connect the corner columns and intermediate columns.

In various embodiments of the present invention, there are raised pedestals that extend above the floor for providing indexing for receipt of a load or module placed on a load holding position of the frame.

BRIEF DESCRIPTION OF THE SEVERAL VIEWS OF THE DRAWINGS

For a further understanding of the nature, objects, and advantages of the present invention, reference should be had to the following detailed description, read in conjunction with the following drawings, wherein like reference numerals denote like elements and wherein.

DETAILED DESCRIPTION OF THE INVENTION

Figure 10:
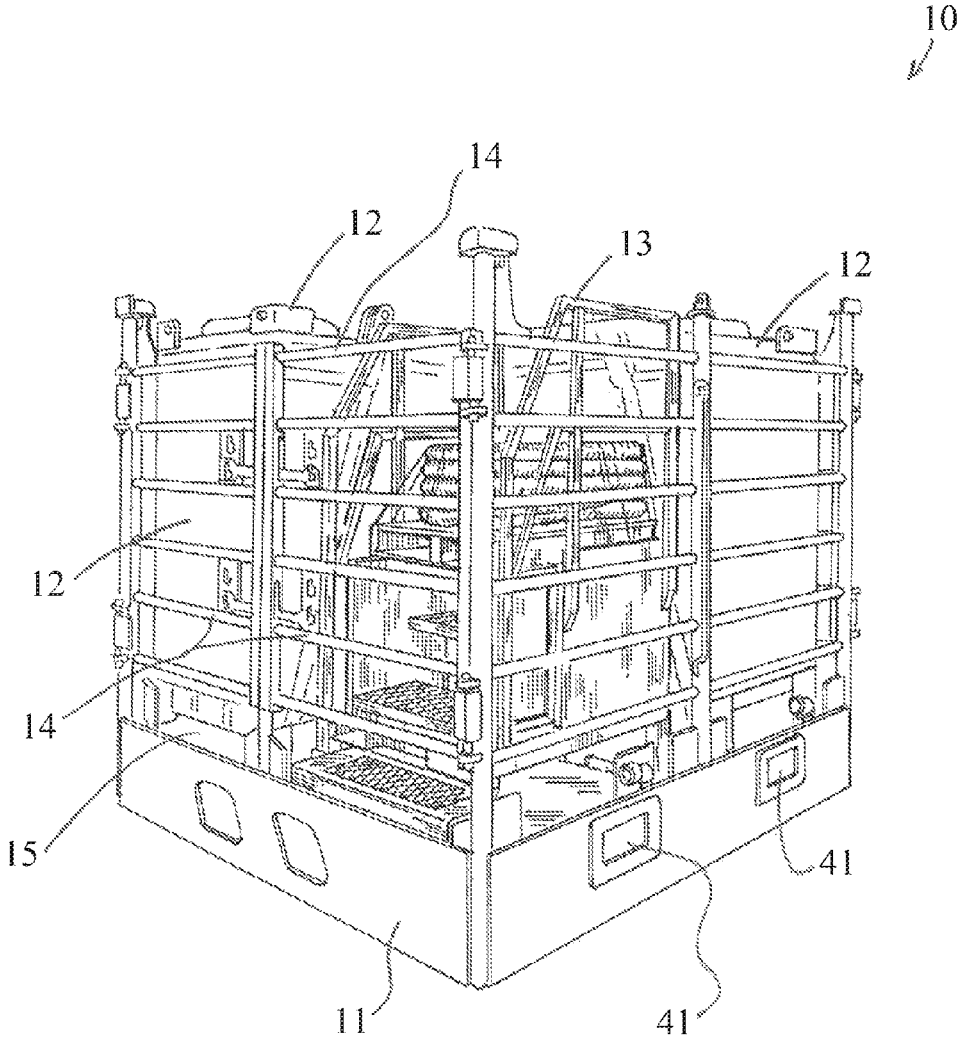
FIG. 10 is a perspective view of the preferred embodiment of the apparatus of the present invention showing the specially configured work platform stored within a larger frame that also houses one or more fluid holding tanks.

FIGS. 1-10 show a preferred embodiment of the apparatus of the present invention designated generally by the numeral 10. As illustrated in FIG. 10, transportable rack apparatus 10 provides a transportable frame 11 that can contain one or more fluid holding tanks 12 and a specially configured work platform 13. Frame 11 can have fork lift tine sockets 41 so that it can be transported with a fork lift.

The present invention also provides a specially configured work platform 13 that can double as a storage or tool box. The work platform 13 includes folding section 19 (see FIG. 6) that is movable between a lowered position 31 and a upper or raised position 32 (see FIGS. 5-7). Transportable rack or frame 11 provides one or more doors 14. The doors 14 can be opened so that a forklift can be used to load a selected tank 12 or work platform 13 onto the floor 15 of the transportable frame or rack 11 (see FIG. 10). Floor 15 can provide multiple load holding positions such as three positions for tanks 12 and one position for work platform 13.

Figure 7:
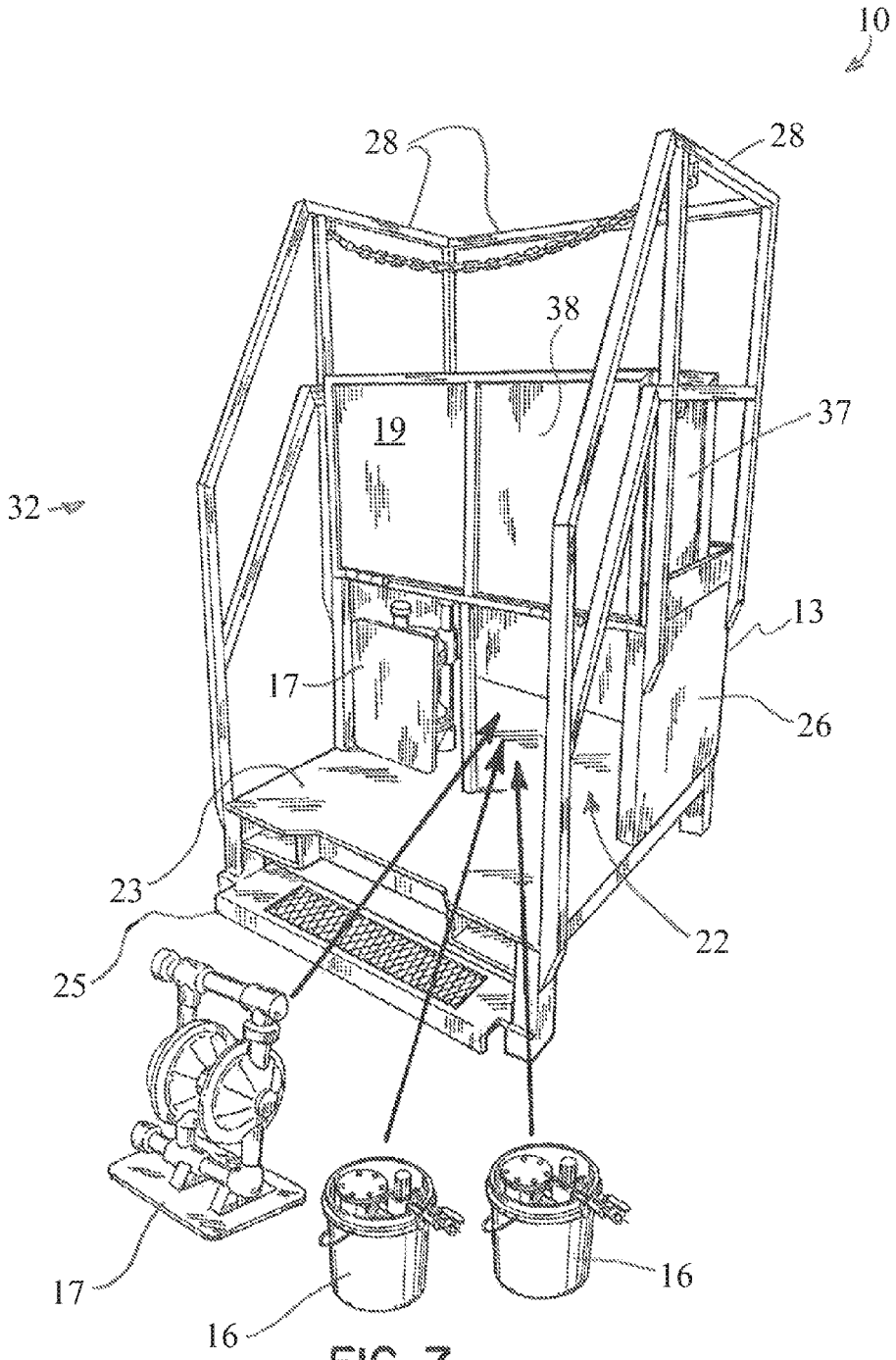
FIG. 7 is a partial perspective view of the preferred embodiment of the apparatus of the present invention showing the staircase in an upper position.
Figure 8:
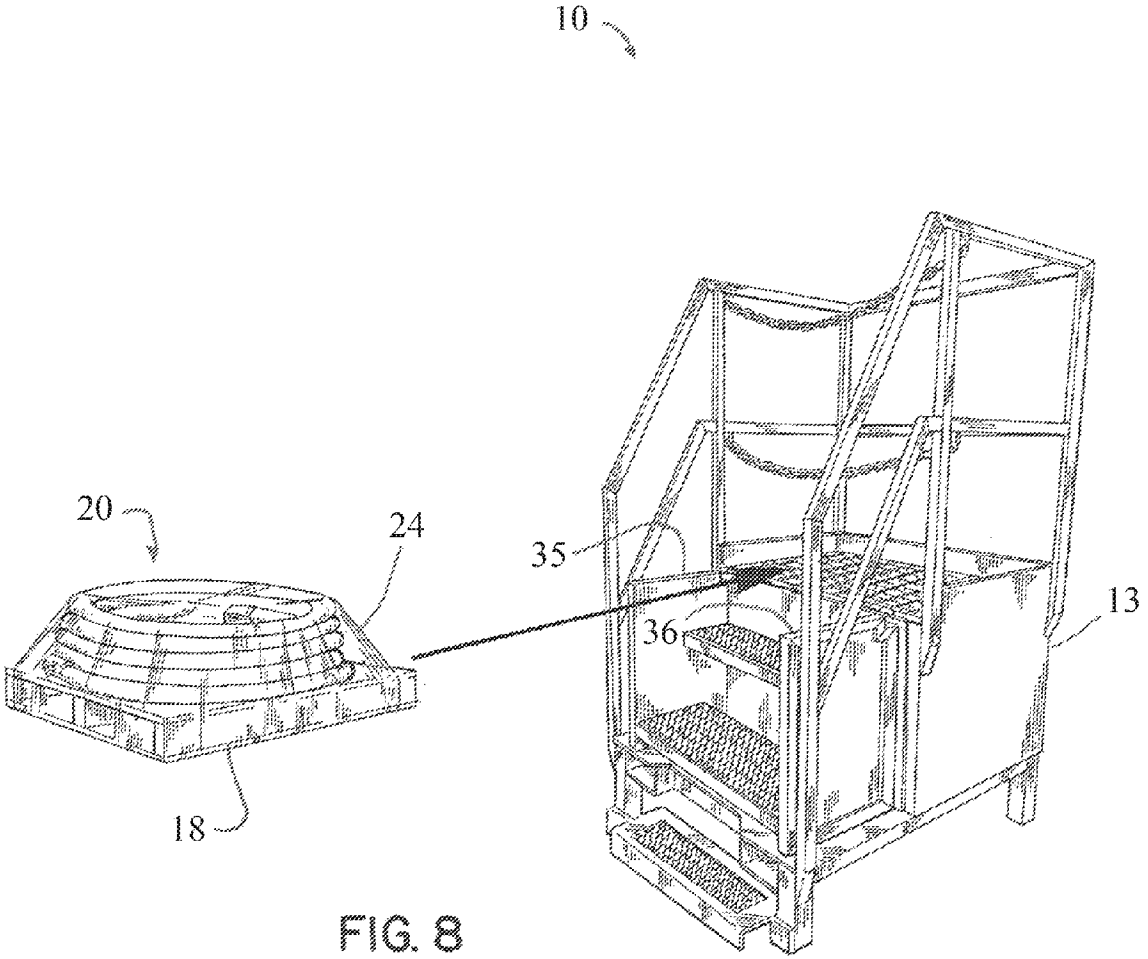
FIG. 8 is a partial perspective view of the preferred embodiment of the apparatus of the present invention.
Figure 9:
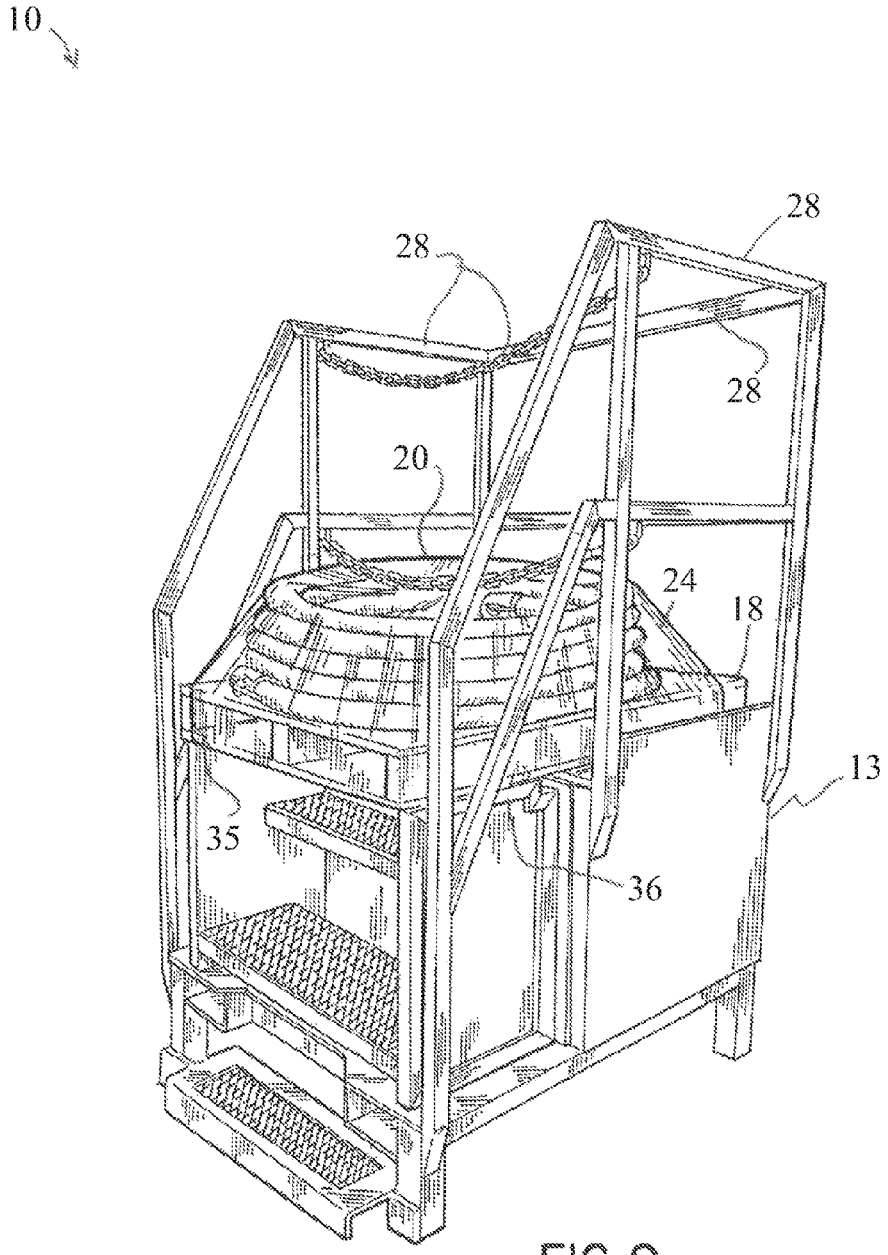
FIG. 9 is a partial perspective view of the preferred embodiment of the apparatus of the present invention.

Work platform 13 can be used to contain a pump 16 and/or pumping equipment 17 and a pallet 18 that can carry other tools or equipment such as hose 20 (see FIGS. 7-8). A plastic film or wrap 24 can encapsulate pallet 18 and hose 20. The work platform 13 has a folding section 19 or folding staircase 19 that is movable between upper (FIG. 7) and lower (FIG. 8) positions. The folding sections or staircase 19 is preferably pivotally attached to work platform 13 at hinge or hinges or pivots 21 (see FIG. 2).

Figure 2:
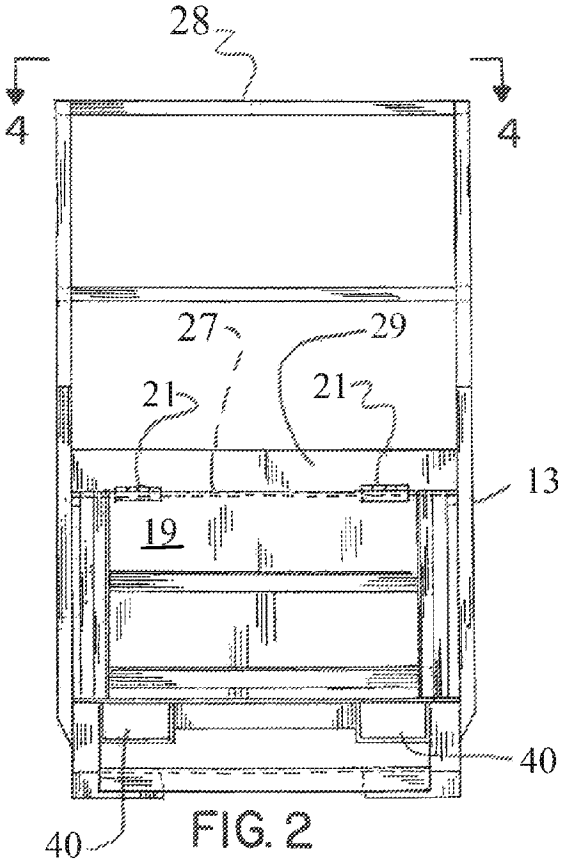
FIG. 2 is a partial end view taken along lines 2-2 of FIG. 1.
Figure 1:
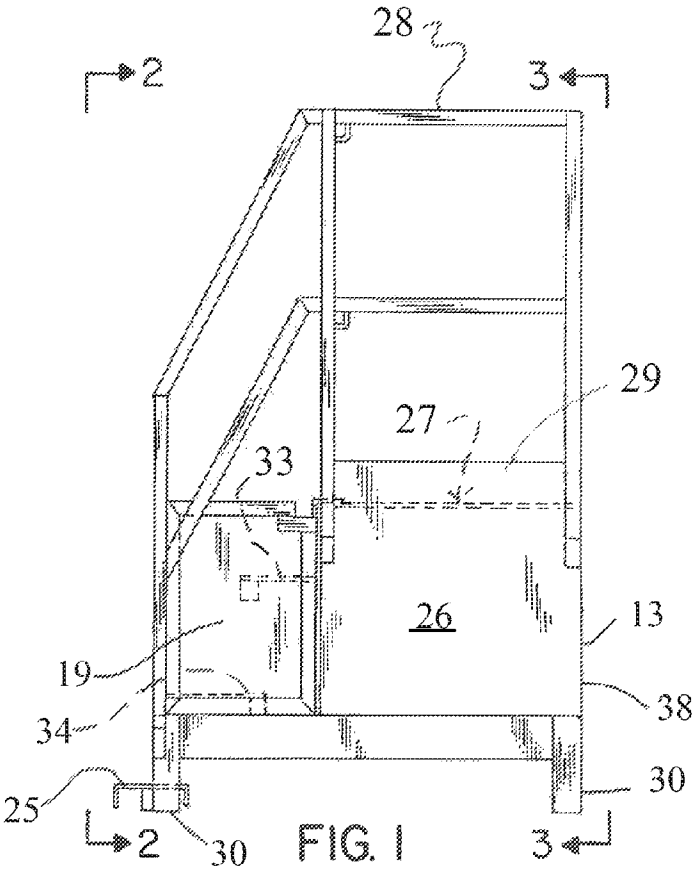
FIG. 1 is a side partial view of the preferred embodiment of the apparatus of the present invention.
Figure 4:
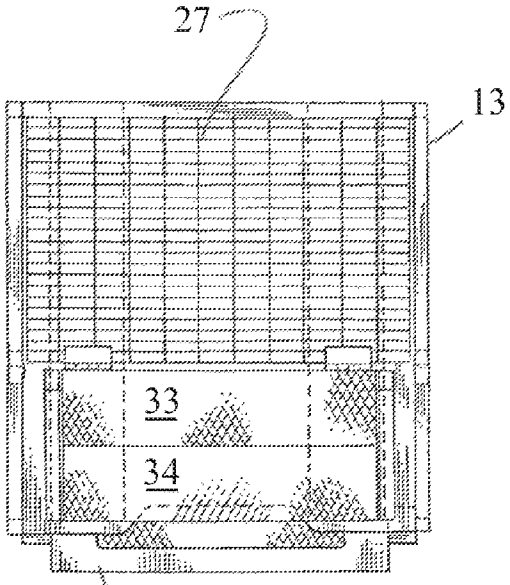
FIG. 4 is a partial top view taken along lines 4-4 of FIG. 2.
Figure 3:
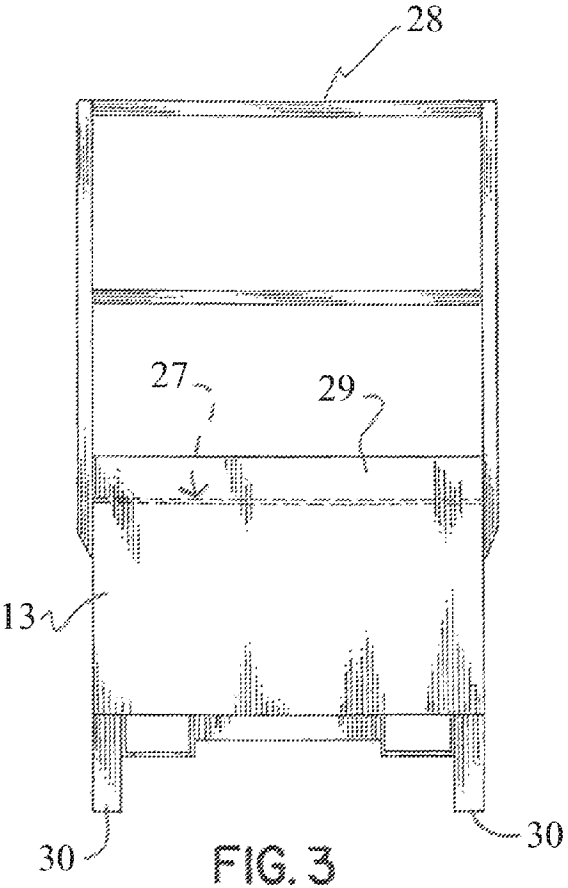
FIG. 3 is a partial rear view taken along lines 3-3 of FIG. 1.
Figure 5:
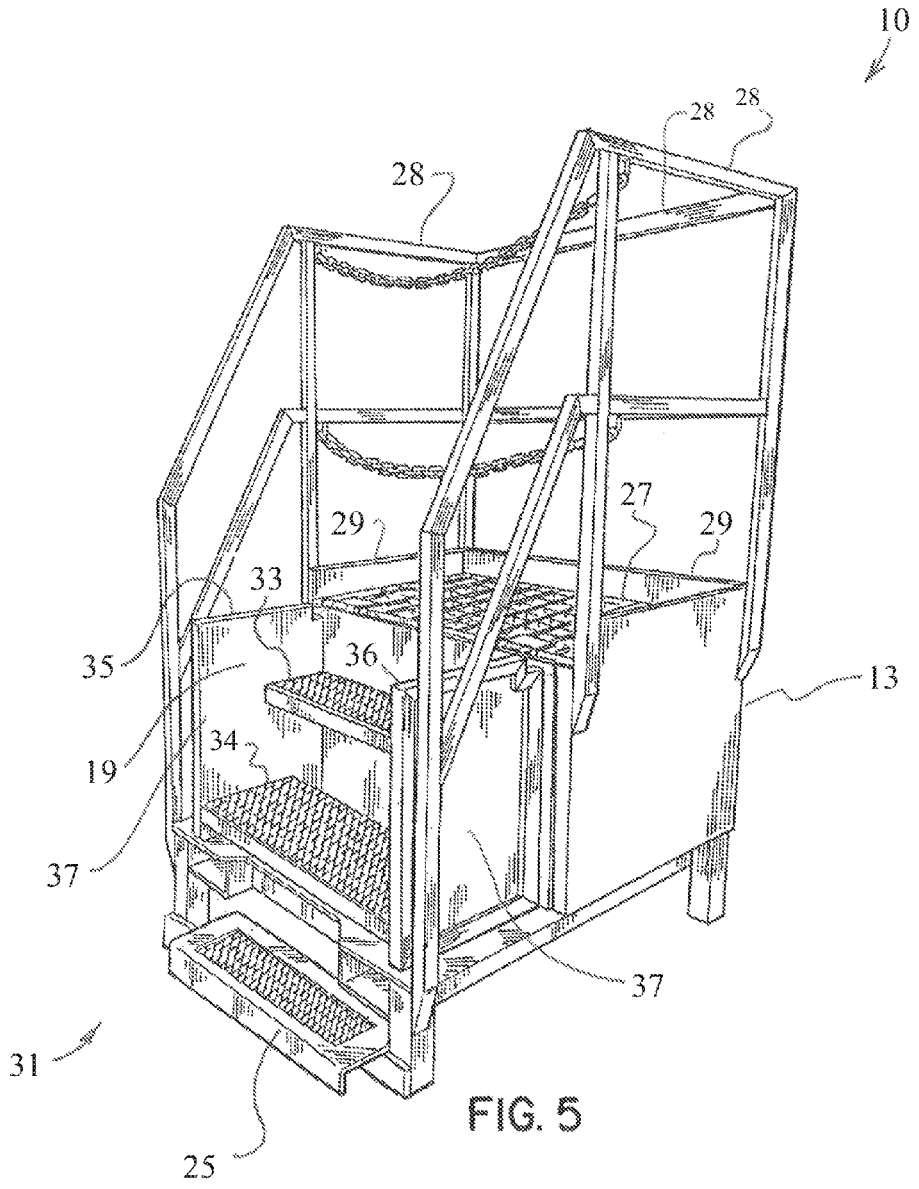
FIG. 5 is a partial perspective view of the preferred embodiment of the apparatus of the present invention showing the staircase in the lower position.

When the folding section 19 is moved to the upper position 32 of FIG. 7 (see arrow 39 of FIG. 6), it exposes a cavity 22 that can contain tools, pumps 16 or pumping related equipment 17, such as seen in FIG. 7. Cavity 22 is bounded by floor 23, side wall panels 26, rear wall 38 and platform surface 27 (see FIGS. 1-2). In the lower position of FIG. 5, the platform 13 provides a bottom step 25, upper step 33, and middle step 34. In FIG. 5, platform surface 27 is a work platform surface that can be occupied by a worker or technician who is attempting to access the upper end portion of a selected fluid holding tank 12. The worker or technician would thus travel upwardly to the platform surface 27 using the steps 25, 34, 33, in that order. Work platform surface 27 can be provided with handrails or railing 28 and a kick panel 29 that extends around surface 27. Work platform 13 can provide sidewalls 26 that surround the cavity 22. Floor 23 of cavity 22 is receptive of tools, pumps 16, pumping equipment 17, or other items to be transported with the work platform 13. The work platform 13 can be provided with a plurality of feet 30 (see FIGS. 1-3). In the drawings, the numeral 31 designates a lowered positioned of the folding section 19. In the drawings, the numeral 32 illustrates the upper or raised position of folding section 19.

Figure 6:
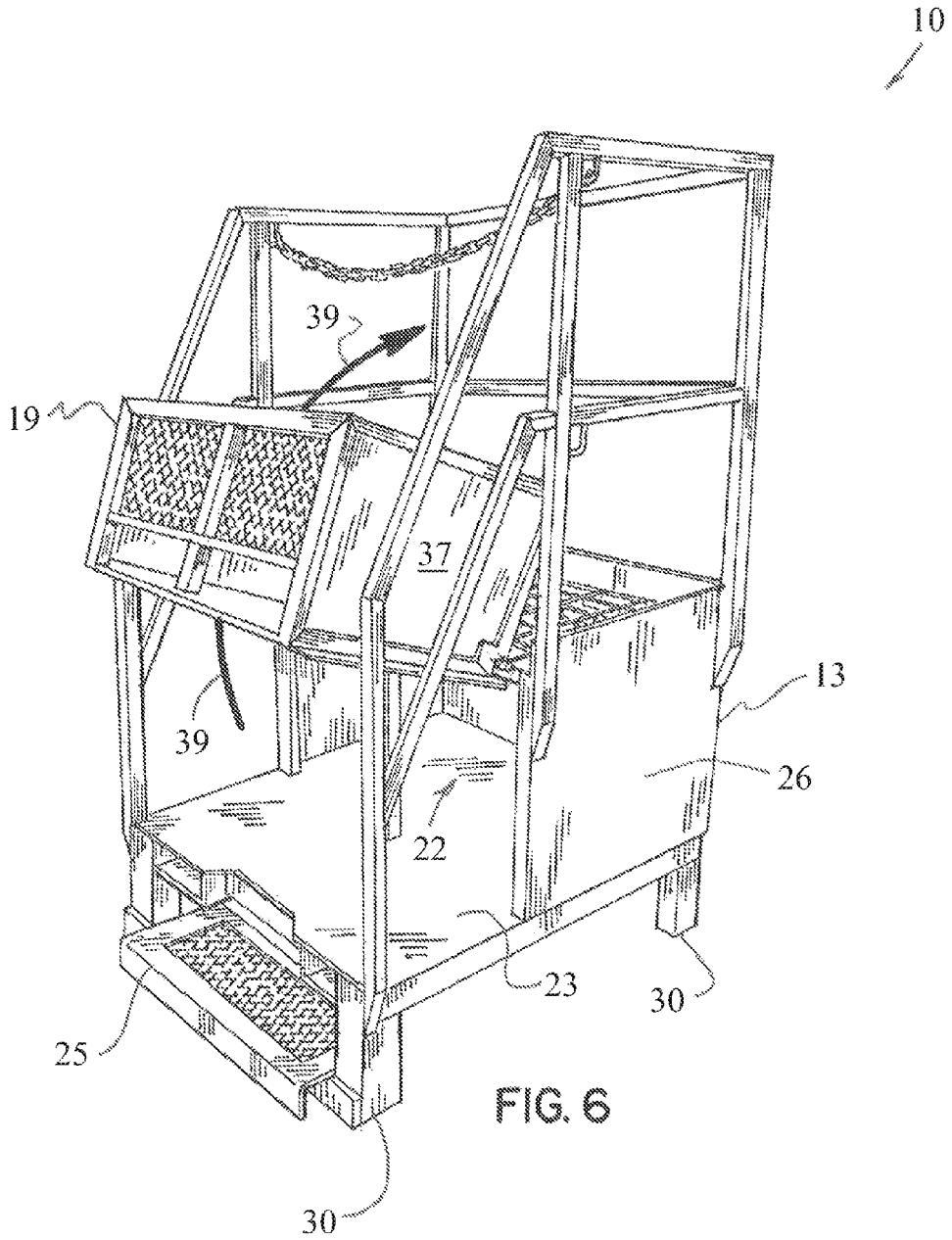
FIG. 6 is a partial perspective view of the preferred embodiment of the apparatus of the present invention showing the staircase in a transition between the lower and upper positions.

FIGS. 5-7 illustrate movement of the folding section 19 about its pivot or pivots or hinges 21 (see arrows 39). In the raised position of FIG. 7, the folding section 19 rests upon work surface/platform surface 27. In the lowered position of FIGS. 1-5 and 8-10, pallet 18 containing hose 20 (and/or other equipment) can be supported upon the combination of work surface/platform surface 27 and upper beams 35, 36 of folding section 19 (see FIG. 9). Folding section 19 can also include side wall panels 37 and rear wall 38 (see FIGS. 6-7). Forklift tine sockets 41 can be provided on work platform/tool box 13 for lifting the work platform 13 and transporting it to or from frame/transportable rack 11 (see FIG. 10).

The folding section 19 can be moved between the lowered position 31 and the raised position 32 while the work platform 13 remains in frame 11 and without regard to whether the doors 14 are opened or closed. FIG. 10 shows the folding section 19 in the lowered position 31 while the doors 14 of frame 11 are closed. In FIG. 10, the door 14 could be opened or closed when the folding section 19 is in the upper or raised position 32. Work platform 13 can have spaced apart fork lift sockets 40 (see FIG. 2) which enable placement on or removal from frame 11 when doors 14 are opened. When doors 14 are open, platform 13 can be removed by a forklift.

The following is a list of parts and materials suitable for use in the present invention:

PARTS LIST:

| PART NUMBER | DESCRIPTION |
|---|---|
| 10 | transportable rack apparatus |
| 11 | frame |
| 12 | tank |
| 13 | work platform/tool box |
| 14 | door |
| 15 | floor |

-continued

PARTS LIST:

| PART NUMBER | DESCRIPTION |
|---|---|
| 16 | pump |
| 17 | pump equipment |
| 18 | pallet |
| 19 | folding section/staircase |
| 20 | hose |
| 21 | hinge/pivot |
| 22 | cavity |
| 23 | floor |
| 24 | plastic film/wrap |
| 25 | bottom step |
| 26 | side wall panel |
| 27 | platform/work surface |
| 28 | railing |
| 29 | kick panel |
| 30 | foot |
| 31 | lowered position |
| 32 | upper/raised position |
| 33 | upper step |
| 34 | middle step |
| 35 | upper beam |
| 36 | upper beam |
| 37 | side wall panel |
| 38 | rear wall |
| 39 | arrow |
| 40 | fork lift sockets |
| 41 | fork lift tine sockets |

All measurements disclosed herein are at standard temperature and pressure, at sea level on Earth, unless indicated otherwise. All materials used or intended to be used in a human being are biocompatible, unless indicated otherwise.

The foregoing embodiments are presented by way of example only; the scope of the present invention is to be limited only by the following claims.

The invention claimed is:

1. A method of transporting fluid containing tanks and of off loading the fluid contents of the tanks, comprising the steps of:

a) providing a frame having a base with a floor, a front, a rear, and upper and lower end portions, the frame including a plurality of side walls extending upwardly from the base and including at least left and right side walls:

b) mounting a plurality of gates to the frame, each spanning between two corner columns, each gate being movable between open and closed positions, the open position of each gate providing an open doorway, the gates enabling a fork lift to place a selected one of the tanks on the floor by moving a selected load module laterally through a said open doorway;

c) the floor having a plurality of load holding positions;

d) placing one or more of said tanks and a work platform on said floor, wherein the work platform has a work surface and a storage area, and a folding staircase that is movable between upper and lower positions, wherein in the lower position, stairs are provided that enable a user to climb the stairs and occupy the platform work surface and wherein in the upper position the stairs are positioned above the work surface;

e) the gates enabling removal of any one of the tanks or the work platform laterally when a said gate is opened and without removing any other one of the tanks;

f) transporting the frame from a beginning location to an ending location; and g) wherein the work platform remains on the frame.

2. The method of claim 1 wherein there are between two and four load holding positions.

3. The method of claim 1 wherein there are a pair of said gates.

4. The method of claim 1 wherein the staircase pivots when moving from the upper and lower position.

5. The method of claim 1 wherein the floor is at least partially inclined.

6. The method of claim 1 wherein one or more pumps are contained in the storage area.

7. The method of claim 4 wherein in the upper position, the staircase and work surface form a co-planar surface.

8. The method of claim 1 further comprising lift eyes on the corner columns.

9. A method of transporting fluid containing tanks and of off loading the fluid contents of the tanks, comprising the steps of:

a) providing a frame having a base with a floor, a front, a rear, and upper and lower end portions, the frame including a plurality of side walls extending upwardly from the base and including at least left and right side walls:

b) mounting a plurality of gates to the frame, each spanning between two corner columns, each gate being movable between open and closed positions, the open position of each gate providing an open doorway, the gates enabling a fork lift to place a selected one of the tanks on the floor by moving a selected load module laterally through a said open doorway;

c) the floor having a plurality of load holding positions;

d) placing one or more of said tanks and a work platform on said floor, wherein the work platform has a work surface and a storage area, and a folding staircase that is movable between upper and lower positions, wherein in the lower position, stairs are provided that enable a user to climb the stairs and occupy the platform work surface and wherein in the upper position the stairs are positioned above the work surface;

e) the gates enabling removal of one of the tanks or the work platform laterally when a said gate is opened and without removing any other one of the tanks; and f) transporting the frame from a beginning location to an ending location; and g) wherein the work platform remains on the frame.

10. The method of claim 9 wherein there are between two and four load holding positions.

11. The method of claim 9 wherein there are a pair of said gates.

12. The method of claim 9 wherein the staircase pivots when moving from the upper and lower position.

13. The method of claim 9 wherein the floor is at least partially inclined.

14. The method of claim 9 wherein one or more pumps are contained in the storage area.

15. The method of claim 13 wherein in the upper position, the staircase and work surface form a co-planar surface.

16. The method of claim 9 further comprising lift eyes on the corner columns.

* * * * *